US010424313B2

(12) United States Patent
Daniel et al.

(10) Patent No.: US 10,424,313 B2
(45) Date of Patent: Sep. 24, 2019

(54) UPDATE OF POST-PROCESSING STATES WITH VARIABLE SAMPLING FREQUENCY ACCORDING TO THE FRAME

(71) Applicant: ORANGE, Paris (FR)

(72) Inventors: Jerome Daniel, Penvenan (FR); Balazs Kovesi, Lannion (FR)

(73) Assignee: ORANGE, Paris (FR)

( * ) Notice: Subject to any disclaimer, the term of this patent is extended or adjusted under 35 U.S.C. 154(b) by 145 days.

(21) Appl. No.: 15/325,643

(22) PCT Filed: Jul. 6, 2015

(86) PCT No.: PCT/FR2015/051864
§ 371 (c)(1),
(2) Date: Jan. 11, 2017

(87) PCT Pub. No.: WO2016/005690
PCT Pub. Date: Jan. 14, 2016

(65) Prior Publication Data

US 2017/0148461 A1 May 25, 2017

(30) Foreign Application Priority Data

Jul. 11, 2014 (FR) ..... 14 56734

(51) Int. Cl.

| | |
|---|---|
| ***G10L 19/24*** | (2013.01) |
| ***G10L 19/26*** | (2013.01) |
| ***G10L 19/12*** | (2013.01) |
| ***G10L 19/18*** | (2013.01) |

(52) U.S. Cl.
CPC ..... *G10L 19/24* (2013.01); *G10L 19/12* (2013.01); *G10L 19/26* (2013.01); *G10L 19/18* (2013.01)

(58) Field of Classification Search
None
See application file for complete search history.

(56) References Cited

U.S. PATENT DOCUMENTS 5,774,452 A * 6/1998 Wolosewicz ..... H04H 20/31 370/212
8,401,865 B2 * 3/2013 Ojala ..... G10L 21/04 704/278
9,489,964 B2 * 11/2016 Kovesi ..... G10L 19/26
(Continued)

OTHER PUBLICATIONS

G.718 (Jun. 2008) "Frame error robust narrowband and wideband, embedded variable bit-rate coding of speech and audio from 8-32 kbits/s", chapter 7.14.1.
G. Roy, P. Kabal, "Wideband CELP speech coding at 16 kbits/sec", ICASSP 1991.
C. Laflamme et al., "16 kbps wideband speech coding technique based on algebraic CELP", ICASSP 1991.
(Continued)

*Primary Examiner* — Marcus T Riley
(74) *Attorney, Agent, or Firm* — David D. Brush; Westman, Champlin & Koehler, P.A.

(57) ABSTRACT

A method and apparatus are provided for updating post-processing states applied to a decoded audio signal. The method is such that, for a current decoded signal frame, sampled at a different sampling frequency from the preceding frame, it includes the following acts: obtaining a past decoded signal, stored for the preceding frame; re-sampling by interpolation of the past decoded signal obtained; using the re-sampled past decoded signal as a memory for post-processing the current frame. A decoding method is also provided, which includes updating post-processing states.

10 Claims, 5 Drawing Sheets

(56) References Cited

U.S. PATENT DOCUMENTS

| | | | | |
|---|---|---|---|---|
| 2007/0040709 | A1* | 2/2007 | Sung | G10L 19/0208 341/50 |
| 2009/0002379 | A1* | 1/2009 | Baeza | G06T 1/20 345/522 |
| 2009/0323826 | A1* | 12/2009 | Wu | H04N 19/895 375/240.27 |
| 2011/0077945 | A1* | 3/2011 | Ojala | G10L 21/04 704/262 |
| 2011/0295598 | A1* | 12/2011 | Yang | G10L 21/038 704/205 |
| 2015/0170668 | A1* | 6/2015 | Kovesi | G10L 19/26 381/66 |
| 2015/0371647 | A1* | 12/2015 | Faure | G10L 19/02 704/203 |
| 2016/0343384 | A1* | 11/2016 | Ragot | H03H 17/0621 |
| 2017/0148461 | A1* | 5/2017 | Daniel | G10L 19/24 |

OTHER PUBLICATIONS

International Search Report dated Sep. 11, 2015 for corresponding International Application No. PCT/FR2015/051864, filed Jul. 6, 2015.

English translation of the International Written Opinion dated Sep. 11, 2015 for corresponding International Application No. PCT/FR2015/051864, filed Jul. 6, 2015.

"ISO/IEC 14496-3:2001(E)—Subpart 3: Speech Coding—CELP", International Standard ISO/IEC, XX, XX, Jan. 1, 2001 (Jan. 1, 2001), pp. 1-172, XP007902532.

"ITU-T G.718—Frame Error Robust Narrow-Band and Wideband Embedded Variable Bit-Rate Coding of Speech and Audio from 8-32 kbit/s", Jun. 30, 2008 (Jun. 30, 2008), XP055087883.

French Search Report and Written Opinion dated Mar. 20, 2015 for corresponding French Application No. 1456734, filed Jul. 11, 2014.

* cited by examiner

UPDATE OF POST-PROCESSING STATES WITH VARIABLE SAMPLING FREQUENCY ACCORDING TO THE FRAME

CROSS-REFERENCE TO RELATED APPLICATIONS

This Application is a Section 371 National Stage Application of International Application No. PCT/FR2015/051864, filed Jul. 6, 2015, the content of which is incorporated herein by reference in its entirety, and published as WO 2016/005690 on Jan. 14, 2016, not in English.

FIELD OF THE DISCLOSURE

The present invention relates to the processing of an audio frequency signal for transmitting or storing it. More particularly, the invention relates to an update of the post-processing states of a decoded audio frequency signal, when the sampling frequency varies from one signal frame to the other.

The invention applies more particularly to the case of a decoding by linear prediction like CELP ("Code-Excited Linear Prediction") type decoding. Linear prediction codecs, such as ACELP ("Algebraic Code-Excited Linear Prediction") type codecs, are considered suitable for speech signals, the production of which they model well.

BACKGROUND OF THE DISCLOSURE

The sampling frequency at which the CELP coding algorithm operates is generally predetermined and identical in each encoded frame; examples of sampling frequencies are:

- 8 kHz in the CELP coders defined in ITU-T G.729, G.723.1, G.729.1
- 12.8 kHz for the CELP part of 3GPP AMR-WB, ITU-T G.722.2, G.718 coders
- 16 kHz in the coders described, for example, in the articles by G. Roy, P. Kabal, "Wideband CELP speech coding at 16 kbits/sec", ICASSP 1991, and by C. Laflamme et al., "16 kbps wideband speech coding technique based on algebraic CELP", ICASSP 1991.

It will further be noted that in the case of a codec as described in ITU-T Recommendation G.718, a processing module is present for improving the decoded signal by low-frequency noise reduction. It is termed "bass post-filter" in English (BPF) or "low-frequency post-filtering". It applies at the same sampling frequency as CELP decoding. The purpose of this post-processing is to eliminate the low-frequency noise between the first harmonics of a voiced speech signal. This post-processing is especially important for high-pitched women's voices where the distance between the harmonics is greater and the noise less masked.

Despite the fact that the common term for this post-processing in the field of coding is "low-frequency post-filtering", it is not, in fact, a simple filtering but rather a fairly complex post-processing that generally contains "Pitch Tracking", "Pitch Enhancer", "Low-pass filtering" or "LP-filtering" modules and addition modules. This type of post-processing is described in detail, for example, in Recommendation G.718 (06/2008) "Frame error robust narrowband and wideband embedded variable bit-rate coding of speech and audio from 8-32 kbits/s", chapter 7.14.1. The block diagram of this post-processing is illustrated in FIG. 29 of the same document.

Here we recall only the principles and elements necessary for understanding the present document. The technique described uses a breakdown into two frequency bands, low band and high band. An adaptive filtering is applied on the low band, determined for covering the lower frequencies at the first harmonics of the synthesized signal. This adaptive filtering is thus parameterized by the period T of the speech signal, termed "pitch". Indeed, the equations of the operations performed by the "pitch enhancer" module are the following: the signal with the enhanced pitch $\hat{s}_f(n)$ is obtained as $$\hat{s}_f(n)=(1-\alpha)\hat{s}(n)+\alpha s_p(n)$$

where $$s_p(n)=0.5\hat{s}(n-T)+0.5\hat{s}(n+T)$$

and $\hat{s}(n)$ is the decoded signal.

This processing requires a memory of the past signal the size of which must cover the various possible values of pitch T (for finding the value $\hat{s}(n-T)$). The value of the pitch T is not known for the next frame, thus, generally, for covering the worst possible case, MAXPITCH+1 samples of the past decoded signal are stored for post-processing. MAXPITCH gives the maximum length of the pitch at the given sampling frequency, e.g. generally this value is 289 at 16 kHz or 231 at 12.8 kHz. An additional sample is often stored for subsequently performing an order 1 de-emphasis filtering. This de-emphasis filtering will not be described here in detail as it does not form the subject of the present invention.

When the sampling frequency of the signal at the input or output of the codec is not identical to the CELP coding internal frequency, a resampling is implemented. For example:

- In 3GPP AMR-WB, ITU-T G.722.2 codecs, the input and output signal in wideband is sampled at 16 kHz but CELP coding operates at the frequency of 12.8 kHz. It will be noted that the codecs of ITU-T G.718 and G.718 Annex C also operate with input/output frequencies of 8 and/or 32 kHz, with a CELP core at 12.8 kHz.
- In the ITU-T G.729.1 codec, the input signal is normally in wideband (at 16 kHz) and the low band (0-4 kHz) is obtained by a bank of QMF filters for obtaining a signal sampled at 8 kHz before coding by a CELP algorithm derived from the codecs of ITU-T G.729 and G.729 Annex A.

Interest is focused here on a category of codecs supporting at least two internal sampling frequencies, the sampling frequency being able to be selected adaptively in time and variable from one frame to the other. Generally, for a range of "low" bitrates, the CELP coder will operate at a lesser sampling frequency, e.g. $fs_1$=12.8 kHz and for a higher range of bitrates, the coder will operate at a higher frequency, e.g. $fs_2$=16 kHz. A change of bitrate over time, from one frame to another, may in this case cause switching between these two frequencies ($fs_1$ and $fs_2$) according to the range of bitrates covered. This switching of frequencies between two frames may cause audible and troublesome artifacts, for several reasons.

One of the reasons causing these artifacts is that switching internal decoding frequencies prevents low-frequency post-filtering from operating at least in the first frame after switching, since the memory of the post-processing (i.e. the past synthesized signal) is found at a sampling frequency different from the newly synthesized signal.

To remedy this problem, one option consists in deactivating the post-processing over the duration of the transition frame (the frame after the change in internal sampling frequency). This option does not produce a desirable result generally, since the noise which was post-filtered reappears abruptly on the transition frame.

Another option is to leave the post-processing active but setting the memories to zero. With this method, the quality obtained is very mediocre.

Another possibility is also to consider a memory at 16 kHz as if it were at 12.8 kHz by only keeping the latest 4/5 samples of this memory or conversely, to consider a memory at 12.8 kHz as if it were at 16 kHz, either by adding 1/5 zeros at the start (toward the past) of this memory in order to have the correct length, or by storing 20% more samples at 12.8 kHz in order to have enough of them in case of a change in internal sampling frequency. The listening tests show that these solutions do not give a satisfactory quality.

There is therefore a need to find a better quality solution for avoiding a break in the post-processing in case of a change in sampling frequency from one frame to the other.

SUMMARY

The present invention will improve the situation.

For this purpose, it provides a method of updating post-processing states applied to a decoded audio frequency signal. The method is such that, for a current decoded signal frame, sampled at a different sampling frequency from the preceding frame, it comprises the following steps:

- obtaining a past decoded signal, stored for the preceding frame;
- resampling the past decoded signal obtained, at the sampling frequency of the current frame, by interpolation;
- using the resampled past decoded signal as a memory for post-processing the current frame.

Thus, the post-processing memory is adapted to the sampling frequency of the current frame which is post-processed. This technique allows improvement in the quality of post-processing in the transition frames between two sampling frequencies while minimizing the increase in complexity (calculation load, ROM, RAM and PROM memory).

The various particular embodiments mentioned below may be added independently or in combination with one another, to the steps of the resampling method defined above.

In a particular embodiment, in the case where the sampling frequency of the preceding frame is higher than the sampling frequency of the current frame, the interpolation is performed starting from the most recent sample of the past decoded signal and by interpolating in reverse chronological order and in the case where the sampling frequency of the preceding frame is lower than the sampling frequency of the current frame, the interpolation is performed starting from the oldest sample of the past decoded signal and by interpolating in chronological order.

This mode of interpolation makes it possible to use only a single storage array (of a length corresponding to the maximum signal period for the greatest sampling frequency) for recording the past decoded signal before and after resampling. Indeed, in both resampling directions, the interpolation is adapted to the fact that from the moment that a sample of the past signal is used for an interpolation, it is no longer used for the next interpolation. It may thus be replaced by that interpolated in the storage array.

Thus, in an advantageous embodiment, the resampled past decoded signal is stored in the same buffer memory as the past decoded signal before resampling.

Thus the use of the RAM memory of the device is optimized by implementing this method.

In a particular embodiment the interpolation is of the linear type.

This type of interpolation is of low complexity.

For an effective implementation, the past decoded signal is of fixed length according to a maximum possible speech signal period.

The method of updating states is particularly suited to the case where post-processing is applied to the decoded signal on a low frequency band for reducing low-frequency noise.

The invention also relates to a method of decoding a current frame of an audio frequency signal comprising a step of selecting a decoding sampling frequency, a step of post-processing. The method is such that, in the case where the preceding frame is sampled at a first sampling frequency different from a second sampling frequency of the current frame, it comprises an update of the post-processing states according to a method as described.

The low-frequency processing of the decoded signal is therefore adapted to the internal sampling frequency of the decoder, the quality of this post-processing then being improved.

The invention relates to a device for processing a decoded audio frequency signal, characterized in that it comprises, for a current frame of decoded signal, sampled at a different sampling frequency from the preceding frame:

- a module for obtaining a past decoded signal, stored for the preceding frame;
- a resampling module for resampling the past decoded signal obtained, at the sampling frequency of the current frame, by interpolation;
- a post-processing module using the resampled past decoded signal as a memory for post-processing the current frame.

This device offers the same advantages as the method previously described, which it implements.

The present invention is also aimed at an audio frequency signal decoder comprising a module for selecting a decoding sampling frequency and at least one processing device as described.

The invention is aimed at a computer program comprising code instructions for implementing the steps of the method of updating states as described, when these instructions are executed by a processor.

Finally the invention relates to a storage medium, readable by a processor, integrated or not integrated in the processing device, optionally removable, storing a computer program implementing a method of updating states as previously described.

BRIEF DESCRIPTION OF THE DRAWINGS

Other features and advantages of the invention will appear more clearly on reading the following description, given solely by way of non-restrictive example, and referring to the attached drawings, in which.

DETAILED DESCRIPTION OF ILLUSTRATIVE EMBODIMENTS

Figure 1:
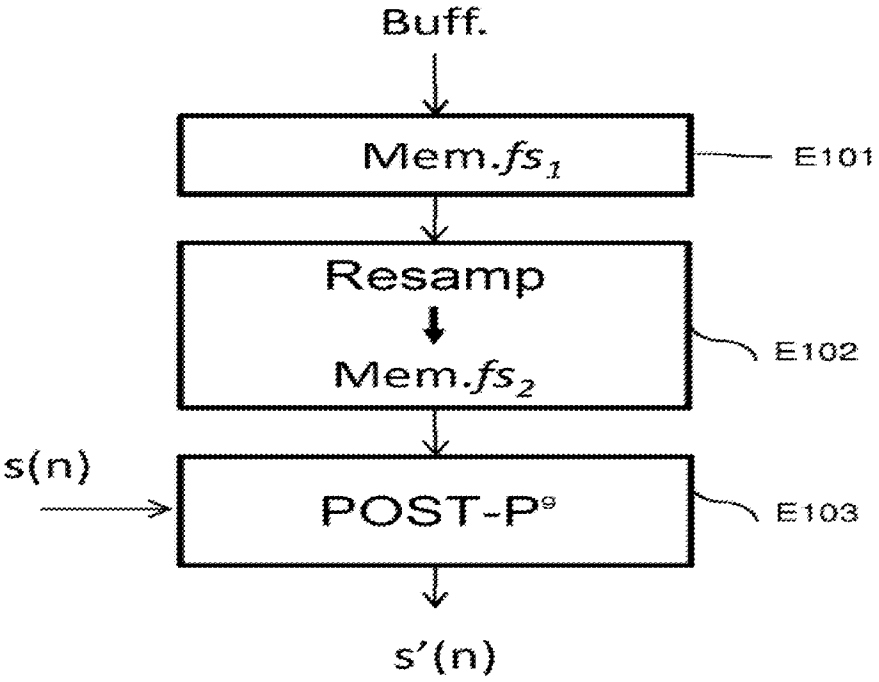
FIG. 1 illustrates in the form of a flowchart a method of updating post-processing states according to an embodiment of the invention.

FIG. 1 illustrates in the form of a flowchart the steps implemented in the method of updating post-processing states according to an embodiment of the invention. The case is considered here where the frame preceding the current frame to be processed is at a first sampling frequency $fs_1$ while the current frame is at a second sampling frequency $fs_2$. In other words, in an application associated with the decoding, the method according to an embodiment of the invention, applies when the CELP decoding internal frequency in the current frame ($fs_2$) is different from the CELP decoding internal frequency of the preceding frame ($fs_1$): $fs_1 \neq fs_2$.

In the embodiment described here, the CELP coder or decoder has two internal sampling frequencies: 12.8 kHz for low bitrates and 16 kHz for high bitrates. Of course, other internal sampling frequencies may be provided within the scope of the invention.

The method of updating post-processing states implemented on a decoded audio frequency signal comprises a first step E101 of retrieving in a buffer memory, a past decoded signal, stored during the decoding of the preceding frame. As previously mentioned, this decoded signal of the preceding frame (Mem. $fs_1$) is at a first internal sampling frequency $fs_1$.

The stored decoded signal length is a function, for example, of the maximum value of the speech signal period (or "pitch").

For example, at 16 kHz sampling frequency the maximum value of the coded pitch is 289. The length of the stored decoded signal is then len_mem_16=290 samples.

For an internal frequency at 12.8 kHz the stored decoded signal has a length of len_mem_12=(290/5)*4=232 samples.

For optimizing the RAM memory the same buffer memory of 290 samples is used here for both cases, at 16 kHz all the indices from 0 to 289 are necessary, at 12.8 kHz only the indices 58 to 289 are useful. The last sample of the memory (with the index 289) therefore always contains the last sample of the past decoded signal, regardless of the sampling frequency. It should be noted that at both sampling frequencies (12.8 kHz or 16 kHz) the memory covers the same temporal support, 18.125 ms.

It should also be noted that at 12.8 kHz it is also possible to use the indices from 0 to 231 and ignore the samples from 232 to 289. Intermediate positions are also possible, but these solutions are not practical from a programming point of view. In the preferred implementation of the invention the first solution is used (indices 58 to 289).

In step E102, this past decoded signal is resampled at the internal sampling frequency of the current frame $fs_2$. This resampling is performed, for example, by a linear interpolation method of low complexity. Other types of interpolation may be used such as cubic or "splines" interpolation, for example.

In a particular advantageous embodiment, the interpolation used allows using only a single RAM storage array (a single buffer memory).

Figure 2:
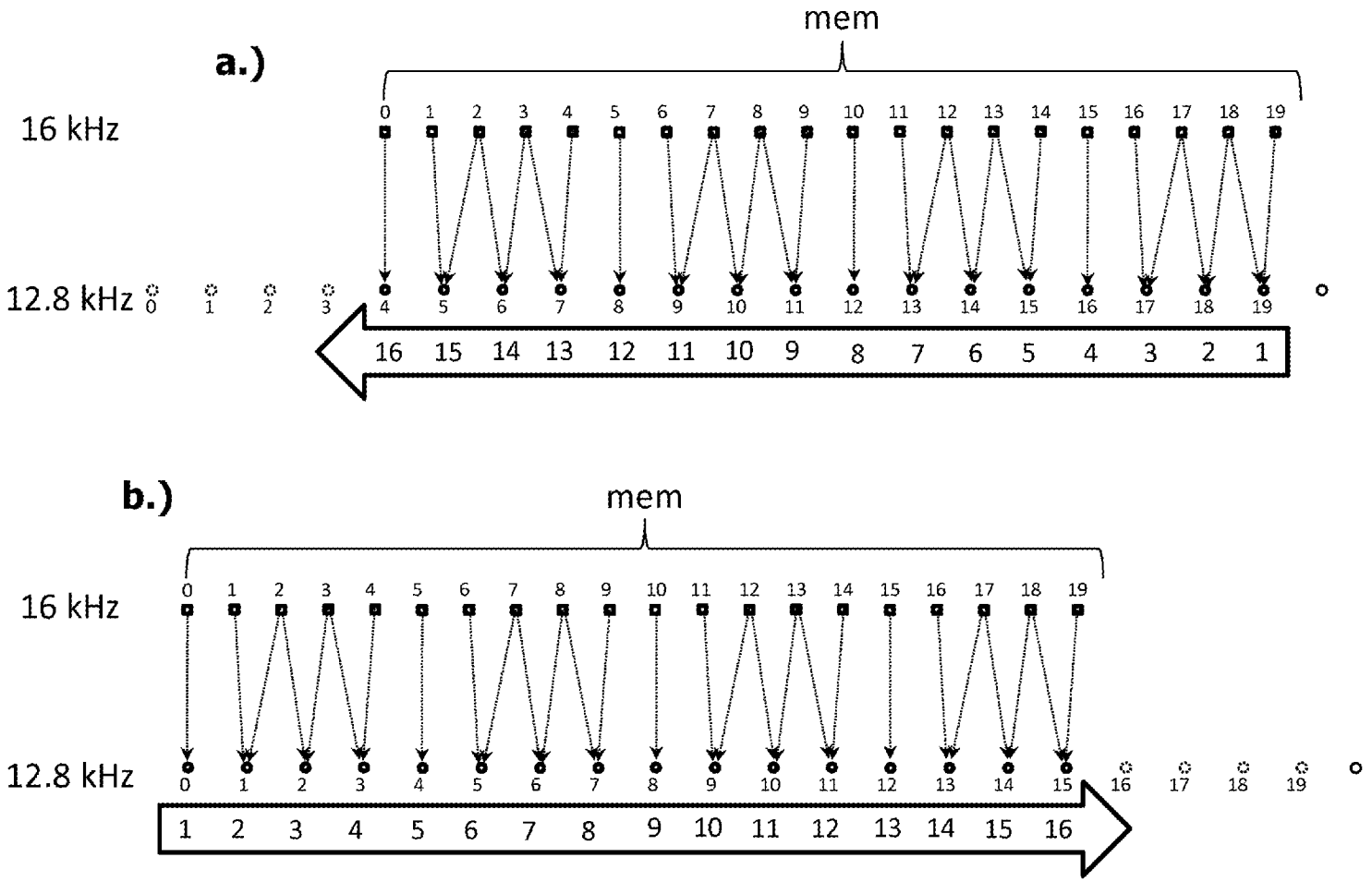
FIG. 2 illustrates an example of resampling from 16 kHz to 12.8 kHz, according to an embodiment of the invention.

The case of a change in the internal sampling frequency from 16 kHz to 12.8 kHz is illustrated in FIG. 2. The lengths represented are reduced here in order to simplify the description. In this figure the length of the memory marked "mem" is len_mem_6=20 samples at 16 kHz (solid square markers) and len_mem_12=16 samples at 12.8 kHz (solid circle markers). The empty circle at 12.8 kHz on the right represents the start of the decoded signal of the current frame. The dotted arrows for each output sample at 12.8 kHz give the input samples at 16 kHz from which they are interpolated in the case of a linear interpolation.

The figure also illustrates how these signals are stored in the buffer memory. In part a.), the samples stored at 12.8 kHz are aligned with the end of the buffer "mem" (according to the preferred implementation). The figures give the location index in the storage array. The empty dotted circle markers of the index 0 to 3 correspond to the locations not used at 12.8 kHz.

It may be observed that by interpolating starting from the most recent sample (therefore that of the index 19 in the figure) and by interpolating in reverse chronological order, the result may be written in the same array since the old value of this location no longer serves for the next interpolation. The solid arrow depicts the interpolation direction, the numbers written in the arrow correspond to the order in which the output samples are interpolated.

It is also seen that the interpolation weights are repeated periodically, in steps of 5 input samples or 4 output samples. Thus, in a particular embodiment, interpolation may take place in blocks of 5 input samples and 4 output samples. There are thus nb_bloc=len_mem_16/5=len_mem_12/4 blocks to be processed.

As an illustration, an example of C language style code instructions is given in Annex 1 for performing this interpolation, where pf5 is an array (addressing) pointer for the input signal at 16 kHz, pf4 is an array pointer for the output signal at 12.8 kHz. At the start both point to the same place, at the end of the array mem of length len_mem_16 (the indices used are from 0 to len_mem_16-1). nb_bloc contains the number of blocks to be processed in the for loop. pf4[0] is the value of the array pointed to by the pointer pf4, pf4[−1] is the preceding value and so on. The same applies to pf5. At the end of each iteration the pointers pf5 and pf4 move back in steps of 5 and 4 samples respectively.

With this solution the increase in complexity (number of operations, PROM, ROM) is very small and the allocation of a new RAM array is not necessary.

Part b.) of FIG. 2 illustrates the case where the samples at 12.8 kHz are aligned with the start of the buffer "mem" and the locations of the index 16 to 19 are not used. In this case, as illustrated by the solid arrow, interpolation must proceed starting from the oldest sample in order to be able to overwrite the result in the same array.

Figure 3:
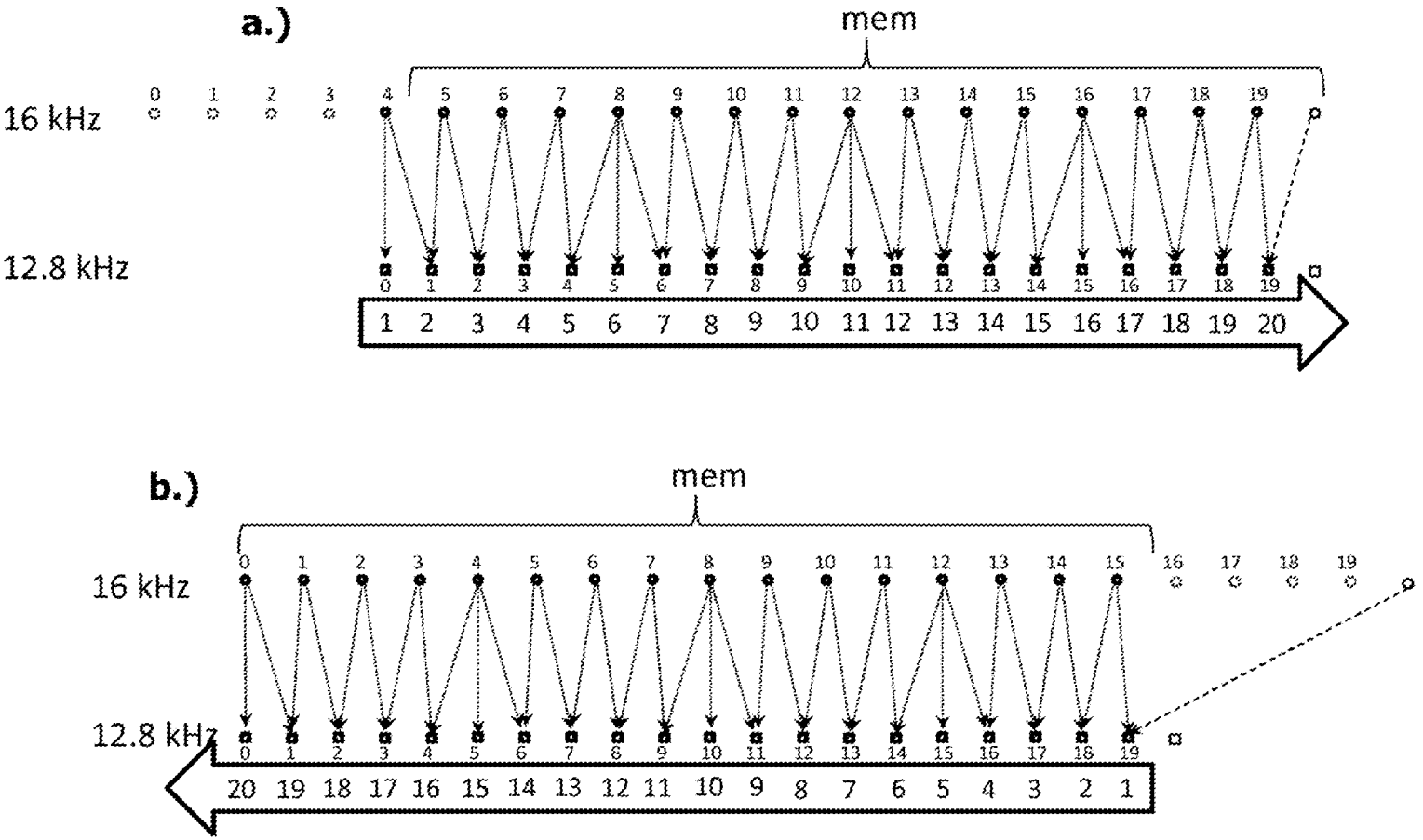
FIG. 3 illustrates an example of resampling from 12.8 kHz to 16 kHz, according to an embodiment of the invention.

In the same way, FIG. 3 illustrates the case of changing the internal sampling frequency from 12.8 kHz to 16 kHz, still with reduced lengths in order to simplify the description: len_mem_16=20 samples at 16 kHz (solid square markers) and len_mem 12=16 samples at 12.8 kHz (solid circle markers). The empty square at 16 kHz represents the start of the decoded signal of the current frame. It should be noted that the first sample of the current frame at 16 kHz is identical to that at 12.8 kHz (same temporal moment), this is represented by an empty circle. The dotted arrows for each output sample at 16 kHz give the input samples at 12.8 kHz from which they are interpolated in the case of a linear interpolation. For interpolating the last output sample the first sample of the current frame at 12.8 kHz must also be used, which as previously explained is well known. This dependency is illustrated by a broken arrow in FIG. 3.

The figure also depicts how these signals are stored in the buffer memory, the figures give the index of the location in the array. In part a.), the samples stored at 12.8 kHz are aligned with the end of the buffer "mem" (according to the preferred implementation). The empty dotted circle markers of the index 0 to 3 correspond to the locations not available (since not used) at 12.8 kHz.

It may be observed that this time, the interpolation is performed starting from the oldest sample (therefore that with index 0 at the output) in order to be able to overwrite the result of the interpolation in the same memory array since the old value at these locations does not serve for performing the following interpolations. The solid arrow depicts the interpolation direction, the numbers written in the arrow correspond to the order in which the output samples are interpolated.

It is also seen that the interpolation weight is repeated periodically, in steps of 4 input samples or 5 output samples. Thus, it is advantageous to perform the interpolation in blocks of 4 input samples and 5 output samples. There are therefore still nb_bloc=len_mem_16/5=len_mem_12/4 blocks to be processed, except that this time, the last block is special since it also uses the first value of the current frame. It is also interesting to observe that the index of the first sample at 12.8 kHz in the memory "mem" (4 in FIG. 3) is equal to the number of blocks to be processed, nb_bloc, since between the 2 frequencies there is one offset sample per block.

As an illustration, an example of C language style code instructions is given in Annex 2 for performing this interpolation:

The last block is processed separately since it also depends on the first sample of the current frame denoted by syn[0].

By analogy with the preceding case, pf4 is an array pointer for the input signal at 12.8 kHz that points to the start of the filter memory, this memory is stored from the nb_bloc$^{th}$ sample of the array mem. pf5 is an array pointer for the output signal at 16 kHz, it points to the first element of the array mem. nb_bloc contains the number of blocks to be processed. nb_bloc-1 blocks are processed in the for loop, then the last block is processed separately. pf4[0] is the value of the array pointed to by the pointer pf4, pf4[1] is the next value and so on. The same applies to pf5. At the end of each iteration the pointers pf5 and pf4 move forward in steps of 5 and 4 samples respectively. The decoded signal of the current frame is stored in the array syn, syn[0]is the first sample of the current frame.

With this solution the increase in complexity (number of operations, PROM, ROM) is very small and the allocation of a new RAM array is not necessary.

Part b.) of FIG. 3 illustrates the case where the samples at 12.8 kHz are aligned with the start of the buffer "mem" and the locations of the index 16 to 19 are not used. In this case, as illustrated by the solid arrow, interpolation must proceed starting from the most recent sample in order to be able to overwrite the result in the same array.

Now back to FIG. 1. After step E102 of resampling the memory Mem. $fs_1$ at the frequency $fs_2$, the memory or resampled past decoded signal, (Mem. fs2) is obtained. This resampled past decoded signal is used in step E103 as a new memory of the post-processing of the current frame.

In a particular embodiment, the post-processing is similar to that described in ITU-T Recommendation G.718. The memory of the resampled past decoded signal is used here for finding the values $\hat{s}(n-T)$ for n=0 . . . T−1 as previously described in recalling the "bass-post-filter" technique in G.718.

Figure 4:
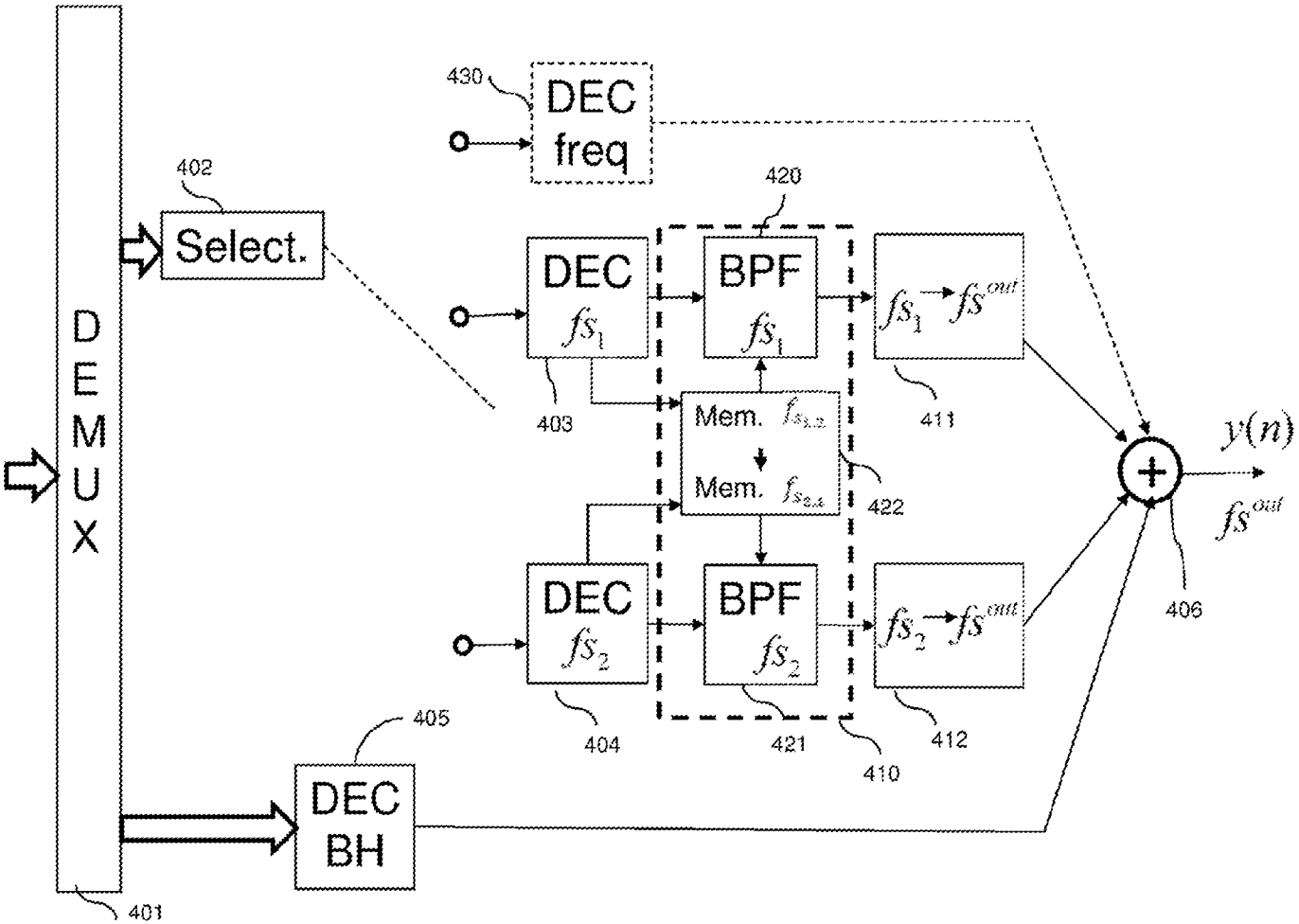
FIG. 4 illustrates an example of a decoder comprising decoding modules operating at different sampling frequencies, and a processing device according to an embodiment of the invention.

FIG. 4 now describes an example of a decoder comprising a processing device 410 in an embodiment of the invention. The output signal y(n) (mono), is sampled at the frequency $fs^{out}$ which may take the values of 8, 16, 32 or 48 kHz.

For each frame received, the binary train is demultiplexed in 401 and decoded. In 402 the decoder determines, here according to the bitrate of the current frame, at what frequency $fs_1$ or $fs_2$ to decode the information originating from a CELP coder. According to the sampling frequency, either the decoding module 403 for the frequency $fs_1$ or the decoding module 404 for the frequency $fs_2$ is implemented for decoding the received signal.

The CELP decoder operating at the frequency $fs_1$=12.8 kHz (block 403) is a multi-bitrate extension of the ITU-T G.718 decoding algorithm initially defined between 8 and 32 kbits/s. In particular it includes the decoding of the CELP excitation and a linear prediction synthesis filtering $1/\hat{A}_1(z)$.

The CELP decoder operating at the frequency $fs_2$=16 kHz (block 404) is a multi-bitrate extension at 16 kHz of the ITU-T G.718 decoding algorithm initially defined between 8 and 32 kbits/s at 12.8 kHz.

The implementation of CELP decoding at 16 kHz is not detailed here since it is beyond the scope of the invention.

There is no interest here in the problem of updating the states of the CELP decoder when switching from the frequency $fs_1$ to the frequency $fs_2$.

The output of the CELP decoder in the current frame is then post-filtered by the processing device 410 implementing the method of updating post-processing states described with reference to FIG. 1. This device comprises post-processing modules 420 and 421 adapted to the respective sampling frequencies $fs_1$ and $fs_2$ capable of performing a low frequency noise reduction post-processing also termed low frequency post-filtering, in a similar way to the "bass post-filter" (BPF) of the ITU-T G.718 codec, using the post-processing memories resampled by the resampling module 422. Indeed, the processing device also comprises a resampling module 422 for resampling a past decoded signal, stored for the preceding frame, by interpolation. Thus, the past decoded signal of the preceding frame (Mem. $fs_1$), sampled at the frequency $fs_1$ is resampled at the frequency $fs_2$ to obtain a resampled past decoded signal (Mem. $fs_2$) used as a post-processing memory of the current frame.

Conversely, the past decoded signal of the preceding frame (Mem. $fs_2$), sampled at the frequency $fs_2$ is resampled at the frequency $fs_1$ to obtain a resampled past decoded signal (Mem. $fs_1$) used as a post-processing memory of the current frame.

The signal post-processed by the processing device 410 is then resampled at the output frequency $fs^{out}$, by the resampling modules 411 and 412, with e.g. $fs^{out}$=32 kHz. This amounts to performing either a resampling of $fs_1$ at $fs^{out}$, in 411, or a resampling of $fs_2$ at $fs^{out}$ in 412.

In variants, other post-processing operations (high-pass filtering, etc.) may be used in addition to or instead of the blocks 420 and 421.

According to the output frequency $fs^{out}$, a high-band signal (resampled at the frequency $fs^{out}$) decoded by the decoding module 405 may be added in 406 to the resampled low-band signal.

The decoder also provides for the use of additional decoding modes such as decoding by inverse frequency transform (block 430) in the case where the input signal to be coded has been coded by a transform coder. Indeed the coder analyzes the type of signal to be coded and selects the most suitable coding technique for this signal. Transform coding is used especially for music signals which are generally poorly coded by a CELP type of predictive coder.

Figure 5:
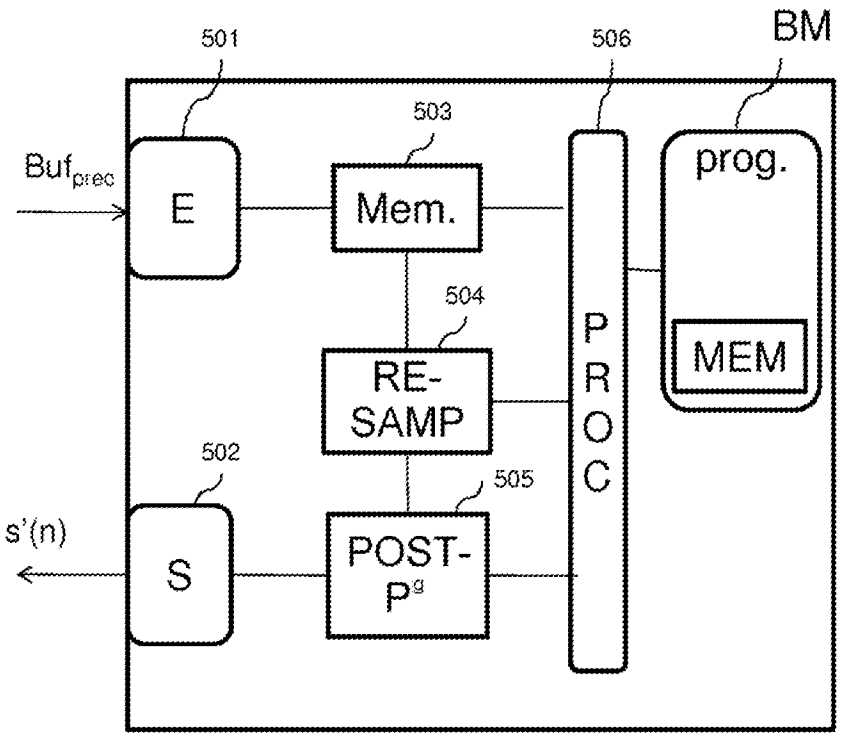
FIG. 5 illustrates a material representation of a processing device according to an embodiment of the invention.

FIG. 5 represents a material implementation of a processing device 500 according to an embodiment of the invention. This may form an integral part of an audio frequency signal decoder or of a piece of equipment receiving audio frequency signals. It may be integrated into a communication terminal, a living-room set-top box decoder or a home gateway.

This type of device comprises a processor PROC 506 cooperating with a memory block BM comprising a storage and/or work memory MEM. Such a device comprises an input module 501 capable of receiving audio signal frames and notably a stored part ($Buf_{prec}$) of a preceding frame at a first sampling frequency $fs_1$.

It comprises an output module 502 capable of transmitting a current frame of a post-processed audio frequency signal s'(n).

The processor PROC controls the module for obtaining 503 a past decoded signal, stored for the preceding frame. Typically, obtaining this past decoded signal is performed by simple reading in a buffer memory, included in the memory block BM. The processor also controls a resampling module 504 for resampling by interpolation the past decoded signal obtained in 503.

It also controls a post-processing module 505 using the resampled past decoded signal as a post-processing memory for performing post-processing of the current frame.

The memory block may advantageously comprise a computer program comprising code instructions for implementing the steps of the method of updating post-processing states within the meaning of the invention, when these instructions are executed by the processor PROC, and notably the steps of obtaining a past decoded signal, stored for the preceding frame, resampling the past decoded signal obtained, by interpolation, and using the resampled past decoded signal as a memory for post-processing the current frame.

Typically, the description of FIG. 1 includes the steps in an algorithm of such a computer program. The computer program may also be stored on a storage medium readable by a drive of the device or downloadable into the memory space thereof.

In a general way the memory MEM stores all the data necessary for implementing the method.

ANNEX 1:

```
pf4 = &mem[len_mem_16-1];
  pf5 = pf4;
  nb_bloc = len_mem_16 / 5;
  for (c=0; c<nb_bloc; c++)
  {
    pf4[0] = 0.75f * pf5[0] + 0.25f * pf5[-1];
    pf4[-1] = 0.50f * pf5[-1] + 0.50f * pf5[-2];
    pf4[-2] = 0.25f * pf5[-2] + 0.75f * pf5[-3];
    pf4[-3] = pf5[-4];
    pf5 -= 5;
    pf4 -= 4;
  }
```

ANNEX 2:

```
nb_bloc = len_mem_16 / 5;
pf4 = &mem[nb_bloc];
pf5 = &mem[0];
for (c=0; c<nb_bloc-1; c++)
{
```

-continued

```
    pf5[0] = pf4[0];
    pf5[1] = 0.2f * pf4[0] + 0.8f * pf4[1];
    pf5[2] = 0.4f * pf4[1] + 0.6f * pf4[2];
    pf5[3] = 0.6f * pf4[2] + 0.4f * pf4[3];
    pf5[4] = 0.8f * pf4[3] + 0.2f * pf4[4];
    pf4 += 4;
    pf5 += 5;
  }
  pf5[0] = pf4[0];
  pf5[1] = 0.2f * pf4[0] + 0.8f * pf4[1];
  pf5[2] = 0.4f * pf4[1] + 0.6f * pf4[2];
  pf5[3] = 0.6f * pf4[2] + 0.4f * pf4[3];
  pf5[4] = 0.8f * pf4[3] + 0.2f * syn[0];
```

Although the present disclosure has been described with reference to one or more examples, workers skilled in the art will recognize that changes may be made in form and detail without departing from the scope of the disclosure and/or the appended claims.

The invention claimed is:

1. A method comprising the following acts performed by a decoding device for an audio frequency signal:

storing a past decoded signal frame in a memory, the past decoded signal frame being decoded from a preceding frame of the audio frequency signal at a first sampling frequency;

receiving a current decoded signal frame, the current decoded signal frame being decoded from a current frame of the audio frequency signal at a second sampling frequency, which is different from the first sampling frequency;

updating post-processing states applied to the current decoded signal frame, the updating comprising:

obtaining the past decoded signal frame, stored for the preceding frame;

resampling the past decoded signal frame obtained, at the second sampling frequency of the current decoded signal frame, by interpolation; and using the resampled past decoded signal frame as a memory for post-processing the current decoded signal frame.

2. The method as claimed in claim 1, wherein, in a case where the first sampling frequency of the preceding frame is higher than the second sampling frequency of the current frame, the interpolation is performed starting from a most recent sample of the past decoded signal frame and by interpolating in reverse chronological order and in a case where the first sampling frequency of the preceding frame is lower than the second sampling frequency of the current frame, the interpolation is performed starting from an oldest sample of the past decoded signal frame and by interpolating in chronological order.

3. The method as claimed in claim 1, wherein the resampled past decoded signal frame is stored in a same buffer memory as the past decoded signal frame before resampling.

4. The method as claimed in claim 1, wherein the interpolation is of a linear type.

5. The method as claimed in claim 1, wherein the past decoded signal frame is of fixed length according to a maximum possible speech signal period.

6. The method as claimed in claim 1, wherein the post-processing is applied to the current decoded signal frame on a low frequency band for reducing low-frequency noise.

7. The method as claimed in claim 1, further comprising:

selecting the second sampling frequency for decoding the current frame;

decoding the current frame of the audio frequency signal at the second sampling frequency to obtain the current decoded signal frame; and then performing the act of updating the post-processing.

8. A device for processing a decoded audio frequency signal, wherein the device comprises:

a non-transitory computer-readable medium comprising instructions stored thereon; and a processor configured by the instructions to perform acts comprising:

storing a past decoded signal frame in a memory, the past decoded signal frame being decoded from a preceding frame of an audio frequency signal at a first sampling frequency;

receiving a current decoded signal frame, the current decoded signal frame being decoded from a current frame of the audio frequency signal at a second sampling frequency, which is different from the first sampling frequency;

updating post-processing states applied to the current decoded signal frame, the updating comprising:

obtaining the past decoded signal frame, stored for the preceding frame;

resampling the past decoded signal frame obtained, at the second sampling frequency of the current decoded signal frame, by interpolation; and using the resampled past decoded signal frame as a memory for post-processing the current decoded signal frame.

9. The device as claimed in claim 8, wherein the device is an audio frequency signal decoder and further comprises a module, which selects a decoding sampling frequency.

10. A non-transitory computer-readable storage medium on which a computer program is stored including code instructions for execution of a method when the instructions are executed by a processor of a decoding device, wherein the instructions configure the decoding device to perform acts comprising:

storing a past decoded signal frame in a memory, the past decoded signal frame being decoded from a preceding frame of an audio frequency signal at a first sampling frequency;

receiving a current decoded signal frame, the current decoded signal frame being decoded from a current frame of the audio frequency signal at a second sampling frequency, which is different from the first sampling frequency;

updating post-processing states applied to the current decoded signal frame, the updating comprising:

obtaining the past decoded signal frame, stored for the preceding frame;

resampling the past decoded signal frame obtained, at the second sampling frequency of the current decoded signal frame, by interpolation; and using the resampled past decoded signal frame as a memory for post-processing the current decoded signal frame.

* * * * *